US007621524B2

(12) United States Patent
Levin

(10) Patent No.: US 7,621,524 B2
(45) Date of Patent: Nov. 24, 2009

(54) METHOD AND DEVICE FOR FEEDING SHEETS ONE BY ONE FROM A PILE OF SHEETS

(75) Inventor: Hans Levin, Örebro (SE)

(73) Assignee: Berg Industries Aktiebolag, Stockholm (SE)

( * ) Notice: Subject to any disclaimer, the term of this patent is extended or adjusted under 35 U.S.C. 154(b) by 332 days.

(21) Appl. No.: 11/587,650

(22) PCT Filed: Apr. 28, 2005

(86) PCT No.: PCT/SE2005/000610

§ 371 (c)(1),
(2), (4) Date: Dec. 19, 2006

(87) PCT Pub. No.: WO2005/105631

PCT Pub. Date: Nov. 10, 2005

(65) Prior Publication Data

US 2007/0164503 A1 Jul. 19, 2007

(30) Foreign Application Priority Data

Apr. 29, 2004 (SE) ..... 0401099

(51) Int. Cl.
*B65H 3/52* (2006.01)

(52) U.S. Cl. ..... 271/123; 271/112

(58) Field of Classification Search ..... 271/23, 271/99, 101, 104, 131–135, 137, 114, 112, 271/123; 414/797.4, 797.5, 797.7
See application file for complete search history.

(56) References Cited

U.S. PATENT DOCUMENTS 549,111 A * 11/1895 Crowell ..... 271/118
3,506,258 A * 4/1970 Lindquist ..... 271/119
3,588,093 A * 6/1971 Ward, Jr ..... 271/99
3,904,190 A * 9/1975 Kuehn ..... 271/99
3,907,278 A * 9/1975 Jaton ..... 271/94
3,994,489 A * 11/1976 Henc ..... 271/132
4,045,015 A * 8/1977 Sardella ..... 271/112
4,614,335 A * 9/1986 Sardella ..... 271/112
4,681,311 A * 7/1987 Sardella ..... 271/11

(Continued)

FOREIGN PATENT DOCUMENTS

EP 0379306 A2 7/1990

(Continued)

*Primary Examiner*—Patrick H Mackey
*Assistant Examiner*—Jeremy Severson
(74) *Attorney, Agent, or Firm*—Buchanan Ingersoll & Rooney PC

(57) ABSTRACT

A method and device for feeding sheets one by one from a stack of sheets to a transportation device are described. The sheet-feeding device comprises a number of parallel, separately driven shafts which are equidistantly spaced from one another and are enclosed in a low-pressure chamber and carry a plurality of feeding wheels. A separating device is arranged above the low-pressure chamber. At least one relieving element is arranged in a vertically displaceable manner between a sheet-supporting position and a non sheet supporting position. Each relieving element is positioned before each wheel shaft and the movement thereof as well as the rotational movement of the wheels are controlled by the control unit depending on the position of the rear edge of the sheet relatively to the wheels.

21 Claims, 6 Drawing Sheets

U.S. PATENT DOCUMENTS 4,715,593 A * 12/1987 Godlewski ..... 271/10.11
4,828,244 A * 5/1989 Sardella ..... 271/11
4,889,331 A * 12/1989 Sardella ..... 271/11
4,896,872 A * 1/1990 Sardella ..... 271/11
5,006,042 A * 4/1991 Park ..... 414/795.4
5,048,812 A 9/1991 Holmes
5,184,811 A * 2/1993 Sardella et al. ..... 271/10.11
5,219,157 A * 6/1993 Takahashi ..... 271/114
5,228,674 A * 7/1993 Holmes ..... 271/11
5,451,042 A 9/1995 Cuir et al.
5,464,202 A * 11/1995 Capdeboscq ..... 271/11
5,531,432 A * 7/1996 Sardella ..... 271/10.01
6,543,760 B1 4/2003 Andrew
6,824,130 B1 * 11/2004 Sardella et al. ..... 271/112

FOREIGN PATENT DOCUMENTS

JP 02066030 A * 3/1990

* cited by examiner

METHOD AND DEVICE FOR FEEDING SHEETS ONE BY ONE FROM A PILE OF SHEETS

BACKGROUND

1. Field

Described herein is a device for feeding sheets one by one from a pile or stack of sheets to a transportation device for transporting the sheet to a process station, the device comprising a low-pressure chamber, a number of separately driven shafts which are positioned perpendicular to the direction of transportation and are arranged in the low-pressure chamber essentially equidistantly spaced from one another and which each carry a plurality of wheels with friction lining, each shaft being driven by its own motor which is connected to and controlled by a control unit, and a separating device which is arranged essentially vertically above the low-pressure chamber and at a distance from the low-pressure chamber that is somewhat larger than the thickness of a sheet.

Described herein is also a method for feeding sheets one by one from a stack of sheets to a transportation device for transporting the sheet to a process station.

The method and a device described herein are particularly suitable for, but not limited to feeding cardboard blanks, for instance corrugated cardboard, from a stack of blanks to a machine for applying text and/or symbols or for punching.

The problems which arise when feeding a (lowermost) sheet of a stack can be explained by the fact that, in practice, it is extremely difficult to feed a sheet without a certain degree of skidding between feeding wheels and sheet, which causes poor repeatability. This is due to the fact that the friction between wheel and sheet changes with the continuously changing number of sheets in the sheaf, type of sheet (surface structure, thickness/weight etc.), changes in speed etc. In conventional she et feeding devices, this has partly been solved by using feeding rolls. A major disadvantage thereof is that sheets of corrugated cardboard are easily deformed or crushed in the press roll nip, which has a detrimental effect on the stackability, shape permanence, etc of the box subsequently produced. In order to minimize the sliding between wheels and the sheet being fed, a large vacuum (negative pressure) has to be used. However, this implies that the next sheet is put down too fast and the contact force between the retarding feeding wheels will be strong, which damages the sheets and wears the wheels out. There is also a risk that the next sheet is fed towards the front sheet support or the separating device, which results in damage to the front edge of the sheet.

This can also lead to the sheet feeding being interrupted when jamming occurs, i.e. two sheets (the one to be fed and the sheet on top thereof) are fed simultaneously into the gap between the sheet support and the feeding table and get stuck. Theoretically, this would be counteracted if a motor with a sufficient braking torque could be used. Then it would, theoretically, be possible to retard the wheel shafts in a considerably shorter time or over a considerably shorter distance. However, this is limited by the performance of commercially available motors which have either too low a maximum torque or too high a mass-moment of inertia. In order to counteract the above-mentioned problems, the vacuum has to be decreased, which has a detrimental effect on the repeatability when uncontrollable sliding (which also depends on the speed, the height of the sheaf etc.) appears.

2. Description of Related Art

A sheet-feeding device of the type defined above is already known from U.S. Pat. No. 5,006,042. This known sheet-feeding device comprises a low-pressure chamber having an integrated feeding table on which a stack of sheets is intended to be placed, and a sheet support at a distance above the feeding table in the order of the thickness of one sheet. A number of shafts are arranged in the low-pressure chamber. The shafts carry a plurality of wheels which protrude through openings in the feeding table and serve to transport the lowermost sheet of the stack through the gap between the feeding table and the sheet support to a belt conveyor. Each shaft is driven by a separate motor. With reference to the reasoning above and to the fact that the distance is relatively large between the wheel shaft closest to the sheet support and on the one hand the sheet support and, on the other hand, the belt conveyor, there is an imminent risk that the sheets arrive inclined and/or with so-called index deviation at the belt conveyor with ensuing problems in the subsequent process station(s). No correction for the above-mentioned deficiencies is indicated in said patent specification. Furthermore, waiting sheets in the stack or sheaf, which due to frictional forces are pressed towards the sheet support (especially at a high level of vacuum), tend to get stuck with their front edge on the sheet support and, thus, be prevented from being correctly put down when sheets that are being fed have completed their feeding cycle. Often a corner of the front edge is pressed against the sheet support. Once the feeding cycle starts, the sheet is damaged or stuck on the sheet support and is not fed in a correct way.

Other problems that are related to sheet-feeding devices of the above-mentioned type are, for example, the following ones: If a "normal" so-called cam graph (movement pattern) in the sheet-feeding cycle is used (see FIG. 7a of U.S. Pat. No. 6,543,760), when changing the speed, the acceleration and retardation ramps (the inclination of the graphs) will change. This implies that, at decreased machine speed, lower retardation of the feeding wheels and longer time to stop the wheels are obtained, although a force for bringing about a faster stop is available in the motor. Consequently, there will be enough time for the next sheet of the sheaf to be sucked down onto the wheels before they have stopped. As a result, the surface layer of the sheet could be damaged by the wheels which spin intensively against the same ("rubbing") and the sheet is advanced to the front sheet support in an uncontrolled manner. Variations in parameters, such as size of sheet, height of sheaf, level of vacuum and machine speed, also result in a change in the total friction acting between sheet and wheels. The variations in friction give rise to variations in the sliding between sheet and wheels which always occurs in connection with the acceleration of a sheet. When the sliding varies, it appears as variations in the index of the sheet. Moreover, there is the ubiquitous stochastic variations in friction from one sheet to another depending on, inter alia, the individual surface structure of each sheet, turbulence in vacuum boxes (low-pressure chambers) etc. which give a stochastic index adding to the above-mentioned reasons for inadequate repeatability.

The starting material for production when using so-called inline machines is corrugated cardboard with formats adapted to the respective series of boxes to be produced. The feeding accuracy is decisive for the positioning of the printing image, slits and punch holes relatively to the front end and the rear end, respectively of the sheet. Accurate positioning of the printing image, slits and punch holes and excellent repeatability from one sheet to the next is essential for the quality of the boxes produced in the converting machine, for example the inline machine. The term feeding accuracy also covers straight feeding relatively to the front and rear end of the sheets. This is a prerequisite for the accuracy in the geometry of the boxes produced and, thus, in the folding process of an inline machine.

Modern converting machines adapted for corrugated cardboard, in particular inline machines, are characterised by high productive capacity. In this connection, high speed is a decisive factor.

So far, attempts to optimise the combination of related properties, feeding that does not crush the sheets, adequate repeatability and high speed, have only been partly successful. It has turned out to be difficult to develop a feeding that is optimised in all areas. Either feeding rolls are used, by means of which a relatively acceptable result is obtained with regard to feeding accuracy and speed, or a system is used which operates without feeding rolls, in which case acceptable accuracy is obtained only at limited speeds. U.S. Pat. No. 6,543,760 discloses a feeding system that is said to be characterised by a combination of the above-related properties. However, it has been found difficult to achieve this combination of high performance, feeding accuracy in connection with said feeding without feeding rolls. The direct cause for this is related to the fact that it has been found that the feeding wheels of this table cannot be stopped as rapidly as required. This is a problem in particular at high speeds, because of the physical properties of the system in combination with the performance of the servo systems available today. It has been found to be impossible to avoid the undesirable roll out of the feeding wheels (or stopping distance). The roll out has a direct affect on the possibility of operating the unit at higher speeds with unchanged feeding accuracy.

U.S. Pat. No. 5,048,812 discloses a sheet feeding device without feeding rolls for feeding of sheets one by one to a process station or sheet processing machine. The device consists of a vacuum box on the top portion of which the sheets are fed and a gate or separating device which releases only one sheet at a time from a stack of sheets to said machine. The vacuum box comprises a first and a second motor-operated drive gear, the first gear, which is located underneath the stack of sheets, being operated at a variable speed while the second gear is operated at a constant speed. Each gear drives a number of shafts at the same speed of rotation and feeding wheels for feeding sheets are arranged on said shafts. Adjacent the vacuum box a housing is provided which contains a motor-driven shaft on which a number of cams are attached. From the vacuum box and directly below and parallel to the wheel shafts underneath the stack of sheets, an associated cam shaft extends into the housing and each cam shaft is provided, inside the housing, with a cam follower engaging the associated cam. Each camshaft is pivotally journalled in the vacuum box and there carries a number of raising elements, which can raise a corresponding number of support elements. These support elements are displaceably positioned around each wheel shaft and between each wheel on the shaft. Programming and adjustment, respectively, of the raising cycles is not possible because of said mechanical, motion-transferring mechanism (cams and cam follower). The support elements can be inactivated only by locking their respective cam followers.

The feeding cycle according to U.S. Pat. No. 5,048,812 starts by the support elements, on which the stack of sheets rests, being lowered from their initial raised positions, so that the lowermost sheet of the stack is brought in contact with the non-rotating feeding wheels, which are subsequently caused to rotate. When the front edge of the sheet being fed hits the feeding wheels of a shaft (27) between the gate and the delivery side (42) the support elements (at 21) closest to the feeding side (38) are raised. The front edge of the sheet then hits the feeding wheels of the next shaft (29) and the succeeding support element (at 23) is raised, and so on until all the support elements are raised and carry the stack of sheets.

In brief, all the wheels underneath the stack of sheets rotate during the whole feeding cycle and at the same speed of rotation. The support elements are raised purely mechanically following a sequence and remain raised until the next sheet feeding cycle begins. Moreover, the support elements and their respective raising mechanisms have a large mass, which reduces the speed and precision of the raising cycles. (Re) programming of the raising cycles is not possible, nor is it possible to drive (or stop) the feeding wheels of a drive shaft at another speed of rotation than that of the feeding wheels of an adjacent drive shaft.

SUMMARY

Described herein is a device and a method for feeding sheets which offers high accuracy in the orientation of the delivered sheets at a high feeding rate.

The device and a method for feeding sheets disclosed herein can also reduce the risk of undesired roll out.

The device and a method for feeding sheets disclosed herein also allow rapid and reliable setting of the sheet feeding cycle with regard to stacks of sheets of various lengths.

These the advantages described above are achievable by means of a sheet-feeding device comprising at least one relieving element, which is arranged in a vertically displaceable manner before and at a distance from the closest shaft in the direction of transportation of the sheets and which is connected to and controlled by said control unit.

A method for feeding sheets by means of a sheet-feeding device as described herein comprises a relieving element that is raised essentially at the same time as the rear edge of the sheet being fed, as seen in the direction of transportation, is moved past said element to a supporting position for the second lowermost sheet of the stack of sheets before the sheet being fed leaves a subsequent shaft, as seen in the direction of transportation, which carries wheels and said shaft is decelerated when the rear edge of the sheet being fed, as seen in the direction of transportation, leaves the wheels of the shaft.

In a particular embodiment, the relieving elements or rails are controlled by the same servo system that controls the rotation of the feeding wheels. This offers unique possibilities of optimising the movement of the relieving rails relatively to the sheet-feeding cycle and the sheet length. It further allows adjustment of the movement of the relieving rails relatively to the stopping distance or roll out effect in connection with the deceleration of the feeding wheels. The system is based on programming the movement of the relieving rails relatively to the sheet cycle of the converting machine (repeater length) and the sheet length. As the sheet length will vary depending on different series of boxes of different dimensions, the movement pattern of the relieving rails is programmed using different parameters depending on the length of the sheets. The system is designed in such manner that this compensation for different sheet lengths is automatic and follows the other settings of the converting machine with regard to the sheet length (i.e. in the machine operating direction).

In a particular embodiment, each relieving rail is controlled separately by the pre-programmed servo system, the following principle for optimising the feeding system forming the base of the programming and the movement of the relieving rails. When the rear edge of the sheet has traveled past the relieving rail, the relieving rail is immediately actuated upwards. After a sufficiently long time has passed to allow a complete stop of the feeding wheels arranged adjacent the relieving rail, the relieving rail is actuated downwards. The movements of each rail are separate and do not occur simultaneously with the movement of other rails. An electromagnet having special properties ensures that the movements of the relieving rails takes place at the speed and timing accuracy required by the system.

BRIEF DESCRIPTION OF THE DRAWINGS

The method and device described herein will be explained more clearly below by means of an example and with reference to the accompanying drawings, in which.

DETAILED DESCRIPTION OF SPECIFIC EMBODIMENTS

The sheet-feeding device or the sheet feeding described herein is a unit which is included in a machine for converting corrugated cardboard or cardboard. In the process before converting, rectangular sheets are made which are cut in a format that suits exactly the box, trough or something else that is to be converted. The sheets are transported by means of, for example, a roller-conveyor system to the converting machine, where the sheets are entered manually or by means of a feeder in the cartridge of sheets of the feeding.

The purpose of the feeding is to feed the sheets so that the sheets enter "pacingly" and at a speed that is pre-set for the machine, the speed having the highest possible repeatability. The sheets are oriented in the storage of sheets of the feeding, so that the sheets are fed as straight as possible. Furthermore, the feeding itself must not contribute to the sheets being fed skewedly (oblique feeding). Since corrugated cardboard is sensitive to high surface pressure, it is advantageous to "calender" the sheets as little as possible (which occurs, for instance, in a press roll nip) when the sheets are drawn out of the sheaf (the lowermost sheet is fed and the stack is supplied with sheets from the top in order to have a continuous feeding). Units that are arranged after the feeding may be printing, slitting, punching and folding units.

Referring first to FIGS. 1-4, a couple of preferred embodiments of the sheet-feeding device described herein have been illustrated. The device is particularly suitable for feeding sheets when a high accuracy is required as regards the positioning and angular orientation of the front edge of the sheet. Moreover, the device allows already printed sheets to be fed having the print downwards, that is, facing the feeding table without scratching or damaging the print. The function of the device is, as described above, to feed sheets 1 one by one from a stack of sheets via a transportation device 2 to a process station (not shown), such as a punch or a folding unit. The transportation device 2 may be a so-called vacuum conveyor, that is, a number of parallel conveyor belts which are arranged in a chamber with negative pressure or a "vacuum box". The particular design of this chamber can, for example, be of the type presented in U.S. Pat. No. 5,006,042.

Figure 3:
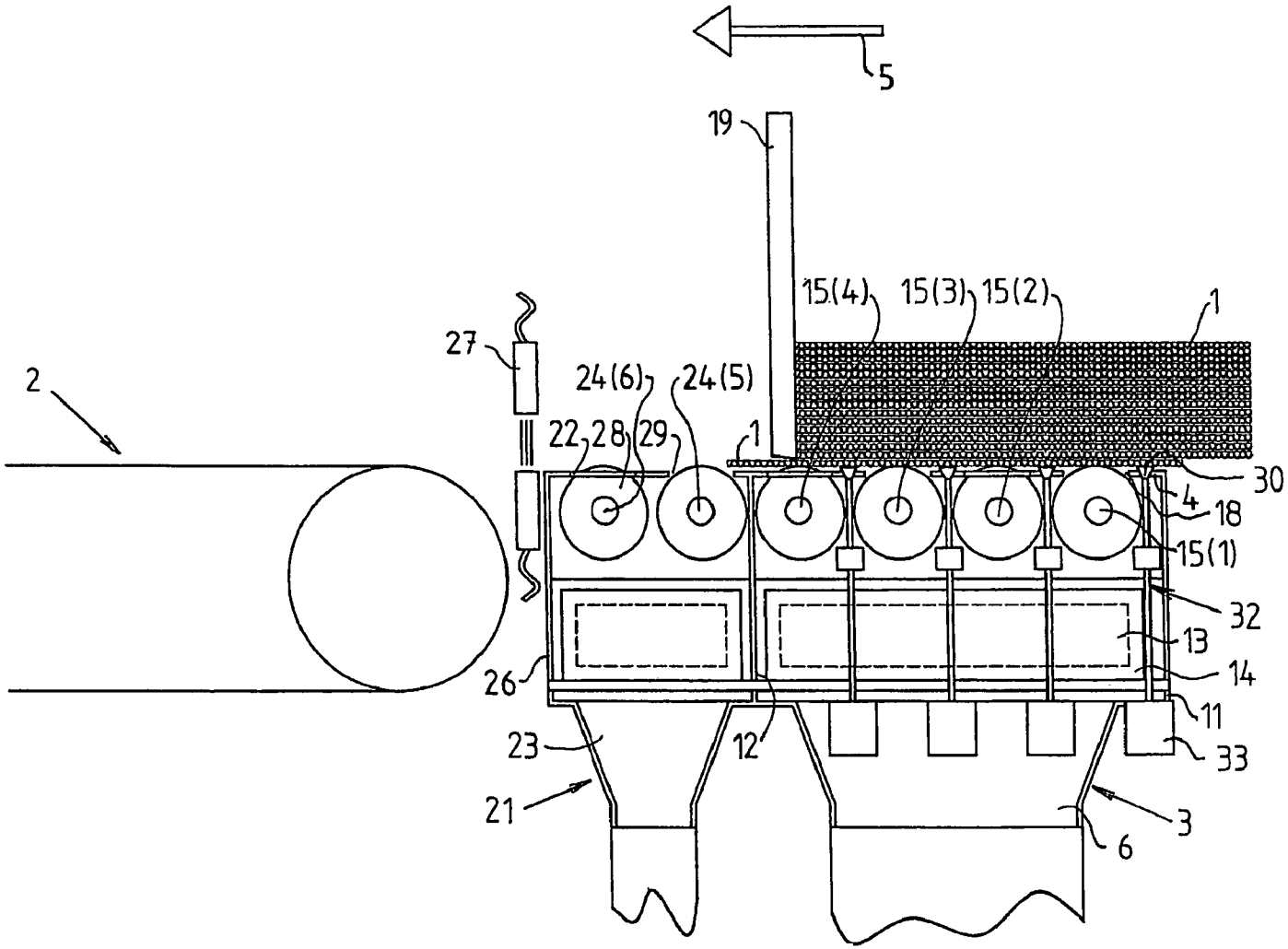
FIG. 3 is a vertical cross-sectional view of the device in FIG. 1, having a feeding table and a sheet support and relieving elements, along the line A-A.

The sheet-feeding device (feeding table) comprises a first low-pressure chamber or "vacuum box" 3 with a feeding table 4, on which the stack of sheets rests, which has been schematically shown in FIG. 3. The feeding table is formed integrally with the low-pressure chamber 3 and forms its top side or upper portion. The low-pressure chamber is divided transversely to the direction of transportation of the sheets, which has been indicated by an arrow 5 in FIG. 3, in a central low-pressure compartment 6 and a number of smaller compartments 6' on both sides of the central compartment. Each compartment 6' is closed downwards by a bottom 7 of the low-pressure chamber 3 (see FIG. 4) and laterally, transversely to the direction of transportation, by partition walls 8 and an end wall 9, respectively. Laterally, along the direction of transportation, each compartment 6,6' is defined by a common end wall 11 and 12, respectively. In each partition wall 8, there is an opening 13, which has been indicated by dashed lines in FIG. 3. By means of these openings, the low-pressure compartments 6' are connected to one another and the central compartment 6 which, in turn, is connected to a suction fan or a suction pump in order to generate negative pressure (partial vacuum) in the low-pressure chamber 3. The openings 13 in the partition walls are separately closable by means of associated, individually operable flaps 14, whereby the effective width of the low-pressure chamber transversely to the direction of transportation can be controlled, depending on the number of compartments 6' which at the moment are connected, as regards (negative) pressure, to the central compartment 6. Thus, the low-pressure chamber 3 can be adapted to the width of the fed sheets 1.

In the feeding table 4, a number of shafts 15 are arranged parallel to one another, transversely to the feeding direction, and are essentially equidistantly spaced from one another. Each shaft 15 is driven by a separate motor, preferably a servomotor 16, which is connected to a control unit or a control system 20 to be further explained in the following. The shafts 15 may extend through the entire low-pressure chamber 3 (see FIG. 2) or, as has been illustrated in FIG. 1, be divided into two separate shaft portions 15' that are aligned with one another having one motor 16 each. It is also possible to let some of the shafts 15 be divided (preferably the shafts closest to the end wall 12) and let the other shafts be undivided. Advantageously, the relative distance between the shafts 15 is kept as small as possible. The shafts 15 are journalled in the partition walls 8 and are in the same (horizontal) plane. A plurality of wheels 17 are fixedly (and detachably) arranged on each shaft 15 and have a friction lining of, for instance, polyurethane on its peripheral surface. When using undivided shafts 15, the distance between adjacent shafts can be made so small that the wheel 17 of a shaft protrudes between the adjacent wheel of the shaft as is shown in FIG. 2. From this figure, it is also evident that the end wall 12 in this case may have an undulating or corrugated form shown in a top plan view.

Figure 4A:
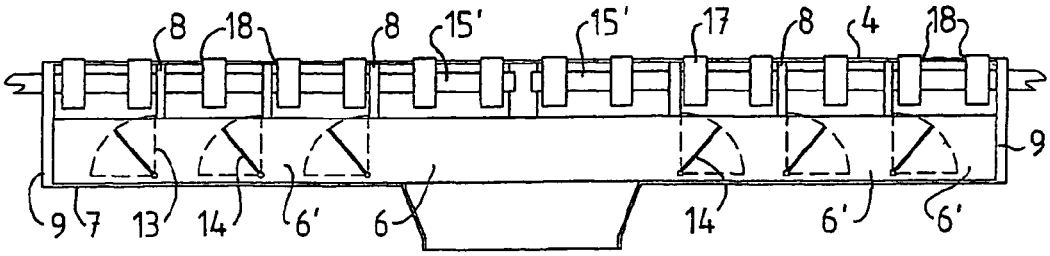
FIGS. 4*a* and 4*b* are vertical cross-sectional views of the device in FIGS. 1 and 2, respectively, perpendicular to the cross-section A-A, along the line B-B.
Figure 4B:
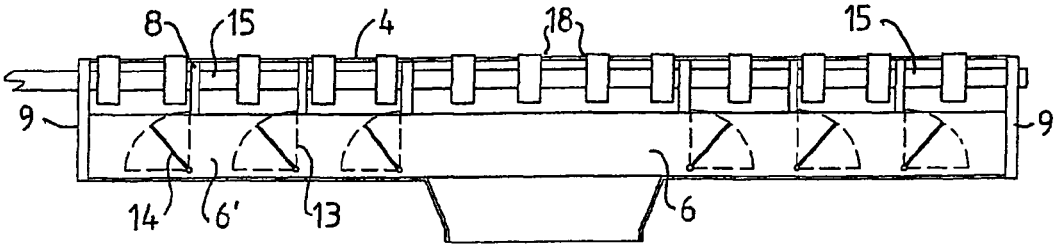

The feeding table 4 is provided with a plurality of openings 18 which in number correspond to the total number of wheels 17 and the wheels 17 protrude a short distance (about 3-5 mm) above the feeding table, see FIGS. 3 and 4. The openings 18 do not fit tightly round the wheels 17, whereby a negative pressure is generated on the upper side of the feeding table 4 by means of suction effect from the low-pressure compartments 6,6', which has been discussed above. The relative distance between the wheels 17 is adapted in such a manner that the (lower-most) sheet does not collapse between the wheels due to the negative pressure. The negative pressure between the lowermost sheet and the upper side of the feeding table results in the sheet being pressed against the coated wheels and it is secured that there is, by a wide margin, a larger frictional force between sheet and wheels than between the lowermost sheet and the next one. The force is so much larger that there is room enough for the contribution from the acceleration by the lowermost sheet in order to avoid sliding. Furthermore, this arrangement gives a minimum moment of inertia.

The distance between the shafts, the diameters of the wheels, the distance between the wheels and the feeding table are adapted so that thin sheets will not collapse and besides there is a safe hold of the sheet during the feeding phase. The wheels overlap in order to obtain maximum bearing capacity in relation to the sheets.

A separating device or "gate" 19 is arranged essentially vertically above the feeding table 4, parallel to the wheel shafts 15 and at a distance from the feeding table that is somewhat larger than the thickness of a sheet. Preferably, the separating device 19 is displaceable in its plane, so that the gap between the separating device and the feeding table can be adapted to varying sheet thickness. The low-pressure chamber 3 extends past the separating device 19 and one of the shafts 15, i.e. the shaft 15 (4) in FIG. 3, is essentially positioned in the same plane as the separating device, which gives a reliable feeding of the lowermost sheet 1(1) past the separating device 19 towards the transportation device 2.

Figure 1:
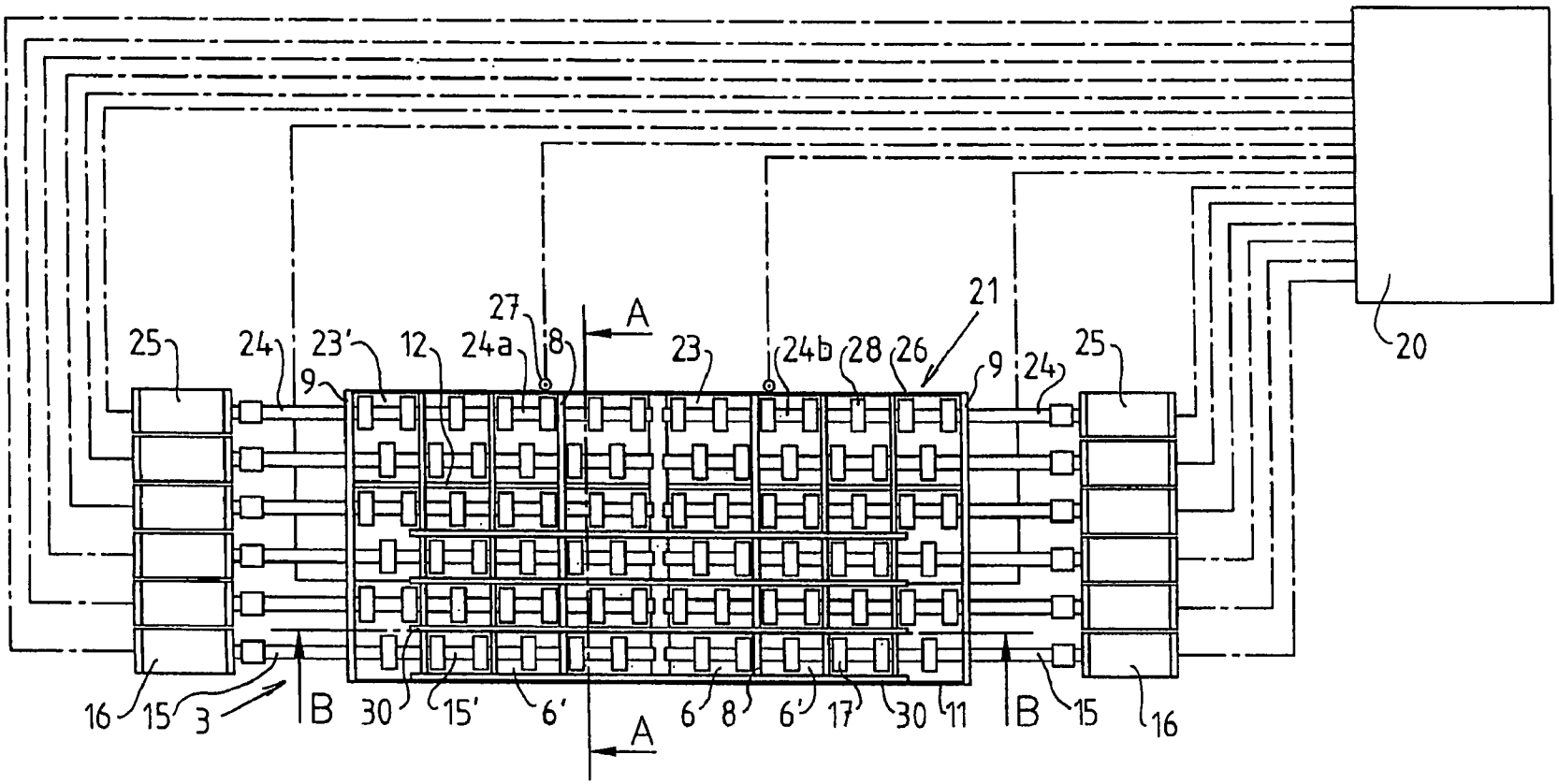
FIG. 1 is a schematic top plan view of an embodiment of a sheet-feeding device described herein, but without feeding table and separating device for better clarity, but with relieving rails.
Figure 2:
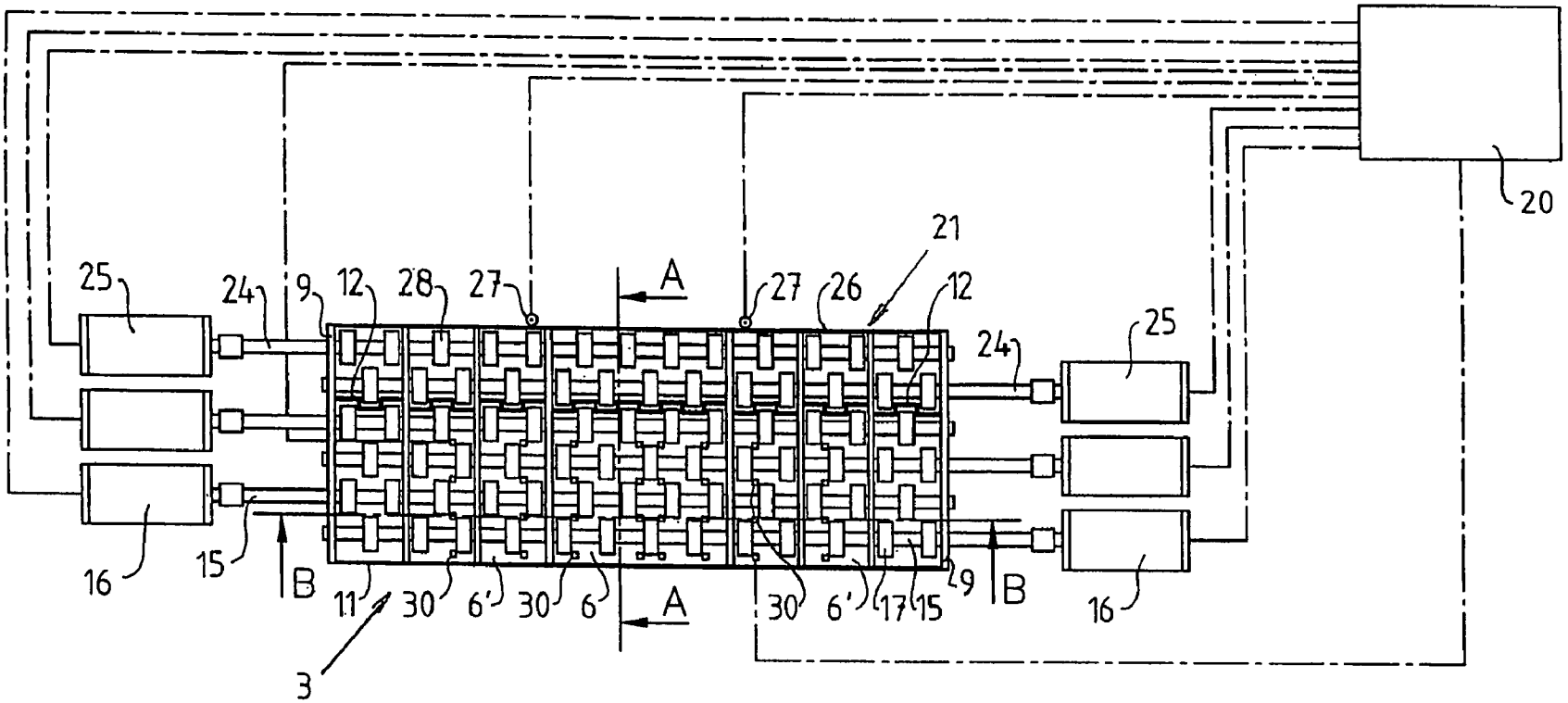
FIG. 2 is a view similar to that in FIG. 1 showing an alternative embodiment of a sheet-feeding device described herein with separate relieving elements.

As is evident from FIGS. 1-3, the device described herein also comprises a second low-pressure chamber 21, which is designed correspondingly to the first low-pressure chamber 3 and whose feeding table 22 forms an extension of, or is integrated with, the feeding table 4, that is the tables 3 and 22 are in the same plane. As is further evident from FIG. 3, the low-pressure chambers are joined to one another (they have a common end wall 12, see FIGS. 1 and 2) and the second low-pressure chamber 21 is positioned between the first low-pressure chamber 3 and said transportation device 2. The central low-pressure compartment 23 of the second low-pressure chamber 21, cf. the central low-pressure chamber 6, is connected to a suction fan or a suction pump which is not necessarily the same as that of the low-pressure compartment 6, that is, the negative pressure may be different in the low-pressure compartments 6 and 23. Besides, low-pressure compartments 23', which are arranged on either side, as well as openings 13 and flaps 14 are arranged in the second low-pressure chamber. Furthermore, at least the last shaft 24(6) (in the direction of transportation) in the second low-pressure chamber 21 may be divided into two shaft portions 24*a* and 24*b*, which has been discussed in connection with the shafts 15 of the first low-pressure chamber 3 and, preferably, in certain applications, all the shafts 24 in the second low-pressure chamber 3 are divided in an indicated manner and each shaft portion 24*a*, 24*b* has its own motor 25 which is connected to said control unit 20. In other applications no shaft 24 is divided, cf. FIG. 2. Preferably, the spacing of the shafts 24 of the second low-pressure chamber, and the distance between the last shaft 15(4) of the first low-pressure chamber in the direction of transportation and the first shaft 24(5) of the second low-pressure chamber in the direction of transportation, is the same as the spacing of the shafts 15 of the first low-pressure chamber, which is evident from FIGS. 1-3. More preferably, the distance between the shafts 15(4) and 24(5) is shorter than the distance between the shafts 15 in the first low-pressure chamber 3 and between the shafts 24 in the second low-pressure chamber 21, respectively.

As is the case for the shafts 15 in the first low-pressure chamber, the shafts 24 in the second low-pressure chamber 21 are journalled in the partition walls 8 and are in the same (horizontal) plane. A plurality of wheels 28 are fixedly (and detachably) arranged on each shaft 24 and have friction lining of, for example, polyurethane on its peripheral surface.

Also the feeding table 22 is provided with a plurality of openings 29 which in number correspond to the total number of wheels 28 and the wheels 28 protrude a short distance (about 3-5 mm) above the feeding table, see FIG. 3. The openings 29 do not fit tightly round the wheels 28, whereby negative pressure is generated on the upper side of the feeding table 22 by means of suction effect from the low-pressure compartments 23,23', which has been discussed above.

In the second low-pressure chamber 21, and preferably, at the end wall 26 of the chamber closest to the transportation device 2, one or more sensors 27 are advantageously arranged, for example, a couple of photo-cells. These are positioned at a relatively large distance from one another, for instance, corresponding to the width of the central low-pressure compartments 6,23 as is evident from FIGS. 1 and 2. The sensors 27 are in a common plane which is parallel to the shafts 15,24 (and thus also to the sheet support 19) and which is essentially perpendicular to the feeding tables 4,22. They detect the front edge of the sheet at two points and, by means of these, it is possible to measure index and skewed feeding and, by means of the control unit 20 and the divided shafts 24 (and 15), for example the shaft portions 24*a* and 24*b*, if necessary, to correct index deviation and angular errors by decelerating the drive motor of one shaft portion (24*a*) and/or accelerate the speed of the drive motor of the other, opposite shaft portion (24*b*). This is carried out by sending signals regarding the front edge of the fed sheet in the direction of transportation to the control unit 20 which compares the actual value with a programmed reference value and sends corresponding correction directions to the above-mentioned motor(s), whereby correction of the position of the sheet is carried out before the sheet is transferred to the transportation device 2. If it is desired to compensate only for index deviation, only one sensor needs to be arranged (not shown). It is then positioned at the same location as any one of the sensors 27 in FIG. 1 or 2, or at a location between their positions. If only correction of index deviation is desired, all the shafts are advantageously undivided, i.e. the embodiment according to FIGS. 2 and 4*b*.

The control unit 20 has yet another purpose, namely, to accelerate and decelerate the shafts 15,24 and, thus, the feeding wheels 17 and 28, respectively, which are attached to the shafts during a sheet-feeding cycle on the one hand in order to move the sheets from the sheet-feeding device to the transportation device at the correct in-line speed, and, on the other hand, in order to prevent the sheets from getting stuck or being damaged on the separating device or in the gap between the separating device and the feeding table.

Referring now to FIGS. 1 and 3, the sheet-feeding device according to the invention comprises one or more relieving elements 30, each of which is arranged respectively before and between a pair of wheel shafts 15 in the first low-pressure chamber 3. Preferably, a relieving element is provided between each wheel shaft in the first low-pressure chamber as illustrated. Each relieving element 30 is vertically displaceable, i.e. perpendicular to the feeding table, between a lowermost position, in which the top portion 31 of the relieving element is positioned at a level below the top portion of the feeding wheels 17, and an uppermost position, in which the top portion of the relieving element is positioned at a level above the top portion of the feeding wheels, see in particular FIG. 5. Moreover, each relieving element has its own raising device 33, preferably an electromagnet, which is connected to and individually controlled by the control unit 20. For the sake of clarity, the raising device 32 of only one relieving element 30 is schematically illustrated in FIG. 1. Openings for the relieving elements are provided in the feeding table 4, see FIG. 5.

Figure 5:
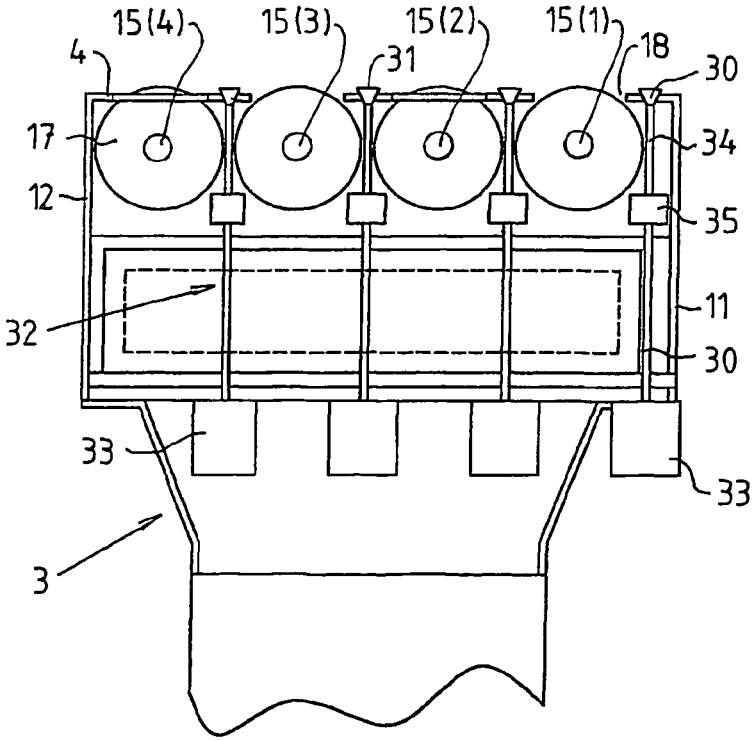
FIG. 5 shows in greater detail but, for the sake of clarity, not to scale a preferred embodiment of a relieving element and its raising device.

FIG. 5 shows an example of the structure of a raising device 32 for a relieving element 30. The raising device comprises an electromagnet 33, which is fixedly attached to the bottom of the low-pressure chamber 3 and from which a push rod 34 extends upwards towards the feeding table 4. At its upper, free end, the push rod is mounted in a slide bearing 35 in a displaceable manner and the relieving element 30 is fixedly attached to the top portion of the push rod. In FIG. 5, the left relieving element is shown in its lowermost position and the right relieving element in its uppermost position.

The relieving element 30 preferably has the form of a rail, which extends parallel to the adjacent wheel shaft and which is positioned before said wheel shaft in the direction of transportation 5 of the sheets; cf. the relieving element 30 and the wheel shaft 15(4) in FIG. 3. In this relieving element structure, a raising device 32 is arranged at both ends of the relieving rail, see FIG. 1, and the two raising devices are controlled synchronously by the control unit 20. The relieving rail is moved by means of the raising devices between its lower-most position and its uppermost position and is at all times oriented parallel to the feeding table 4. As shown in FIG. 1, a relieving rail is advantageously arranged in the direction of transportation before each wheel shaft, i.e. between each pair of adjacent wheel shafts, except for the relieving rail arranged furthest away from the separating device 19, as shown in FIG. 3, but exceptions from this are possible in special applications of the sheet-feeding device described herein.

It is also conceivable, of course, to provide the relieving elements 30 as a number of separate units, which are grouped along a line in between two adjacent wheel shafts, as indicated in FIG. 2. This may be advantageous when the wheel shafts are located very close to one another. Each individual relieving unit is connected to and controlled by the control unit 20, either individually or together with the other relieving units of the same row, i.e. along the same wheel shaft.

FIGS. 6*a*-6*f* schematically illustrate a method according to the invention for effecting a sheet-feeding cycle.

In FIG. 6 a sheet-feeding cycle have been illustrated for the sheet-feeding device presented above, that is, a device which has four shafts 15(1)-15(4) journalled in the first low-pressure chamber 3 and two shafts 24(5)-24(6) journalled in the second low-pressure chamber 21. As stated above, the motors 16,25 are controlled individually by the control unit 20. In the beginning of a feeding cycle, FIG. 6*a*, all the motors are started simultaneously and accelerate the lowermost sheet 1(1), so that it reaches its speed reference value.

The shafts 15(1)-15(4) are driven by a speed profile which starts a feeding cycle with immobile shafts and with a sheet resting on their wheels. In the beginning of a feeding cycle, all the shafts start simultaneously and accelerate from a standstill to the in-line speed of the machine. By static friction between sheet and wheels, the lowermost sheet 1(1) follows the forward movement and is fed forward in the direction of transportation (arrow 5).

Figure 6A:
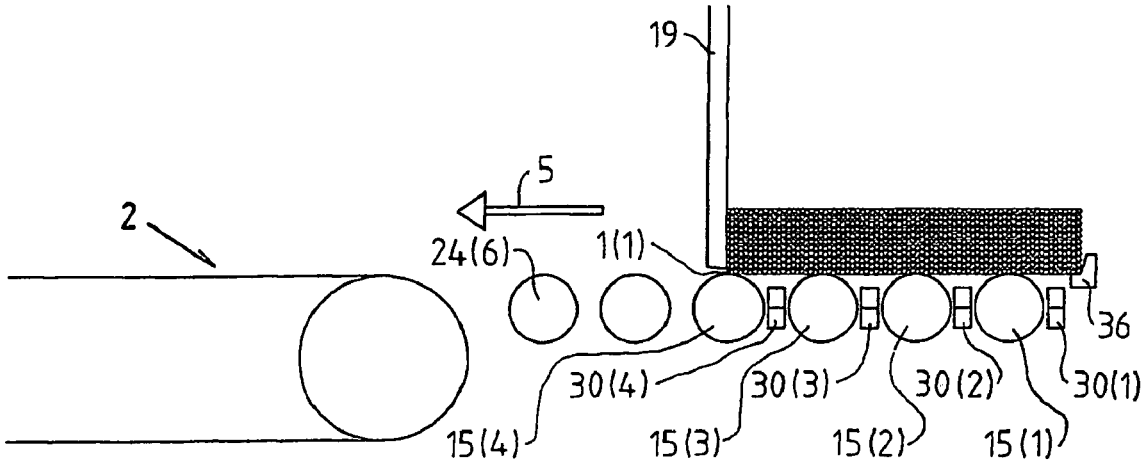
FIGS. 6*a*-6*f* illustrate the different steps of a sheet-feeding cycle.
Figure 6B:
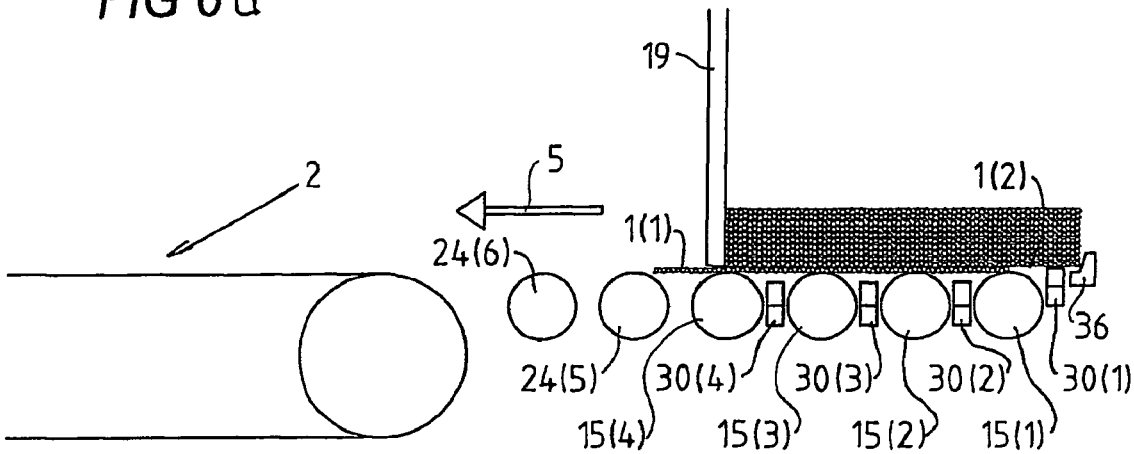

When the rear edge of the lowermost sheet 1(1), as seen in the direction of transportation, passes the first relieving element 30(1) in the direction of transportation, the control unit 20 issues a command instructing the raising device 32 of the relieving element to move the relieving element from its lowermost position to its uppermost position in order to support the second lower-most sheet 30(2), see FIG. 6*b*. This displacement of the relieving element to a supporting position for the second lowermost sheet is such that the top portion 31 of the relieving element is brought essentially to the exact same level as the underside of said sheet, and thus no raising movement is applied to the stack of sheets the consequence of which would be a load on the raising device of the relieving element. The distance that the top portion of the relieving element is displaced, i.e. the level to which the relieving element is moved to a sheet-supporting position, is of course adjustable and can be adjusted to the thickness of the fed sheets. As the rear edge of the sheet moves past the first row of wheels of the first shaft 15(1), as seen in the direction of transportation, i.e. the shaft that in the low-pressure chamber is located furthest away from the separating device 19, the control unit 20 decelerates the (servo) motor 16 of this shaft.

Figure 6C:
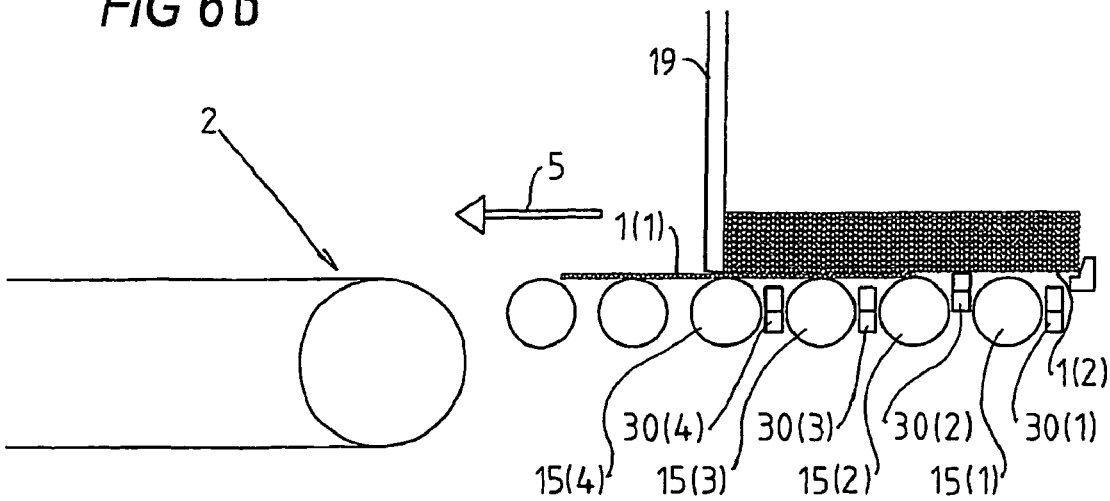

In the next step of the sheet-feeding cycle, see FIG. 6*c*, when the rear edge of the lowermost sheet 1(1) passes the raising device of the subsequent relieving element 30(2), the control unit 20 issues a command to the effect that the relieving element be moved to its uppermost position in order to support the second lower-most sheet 1(2). When the rear edge of the sheet passes the row of wheels of the next shaft 15(2), the control unit 20 decelerates this shaft. In this connection, the first shaft 15(1) has been stopped and the control unit 20 has issued a command to the raising device of the first relieving element 30(1) instructing it to move the relieving element from its uppermost position to its lowermost position, the row of wheels of the first shaft 15(1) supporting the second lowermost sheet 1(2) instead of the first relieving element 30(1).

Figure 6D:
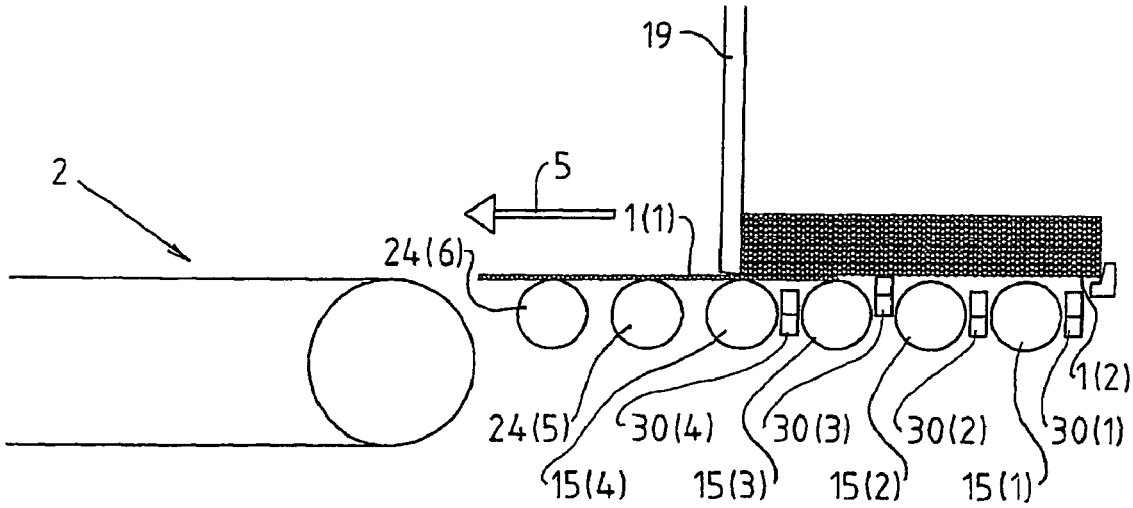

FIG. 6*d* shows the next step of the sheet-feeding cycle. In a manner corresponding to the step according to FIG. 6*c*, when the rear edge of the lowermost sheet 1(1) passes the raising device of the relieving element 30(3), the control unit 20 issues a command to the effect that the relieving element be moved to its uppermost position in order to support the second lowermost sheet 1(2). When the rear edge of the sheet then passes the row of wheels of the subsequent shaft 15(3) the control unit 20 decelerates this shaft. In connection with the previous shaft 15(2) being stopped the control unit 20 issues a command to the raising device of the previous relieving element 30(2) instructing it to lower the relieving element to its lowermost position, the row of wheels of the shaft 15(2) thereby supporting the second lowermost sheet 1(2). This procedure is repeated for each subsequent wheel shaft in the low-pressure chamber 3.

A common feature of the above steps of the sheet-feeding cycle is that the relieving element is moved to its uppermost position before the lowermost sheet 1(1) leaves the wheel of the following wheel shaft in the sheet-feeding direction.

Figure 6E:
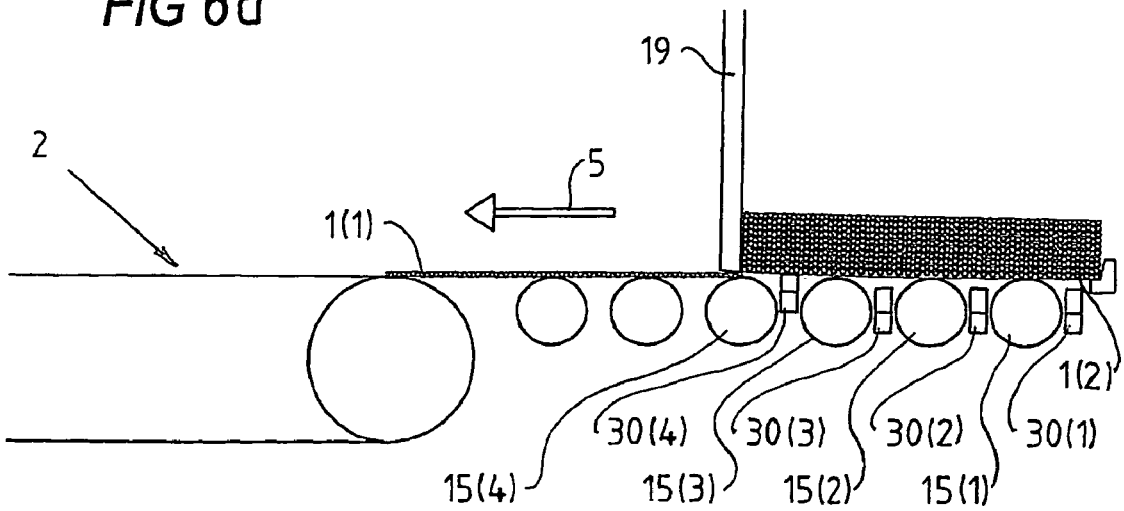

In FIG. 6*e*, the lowermost sheet 1(1) has been discharged from the stack of sheets, through the opening between the separating device 19 and the feeding table 4, to the transport device 2. The wheel shaft 15(4) is decelerated and all the relieving elements 30(1), 30(2) and 30(3) has been brought to their lowermost position by the control unit 20. Alternatively, the relieving element 30(3) may remain in its uppermost position until the wheel shaft 15(4) underneath the separating device 19 has been stopped, following which it is lowered to its lower-most position.

Figure 6F:
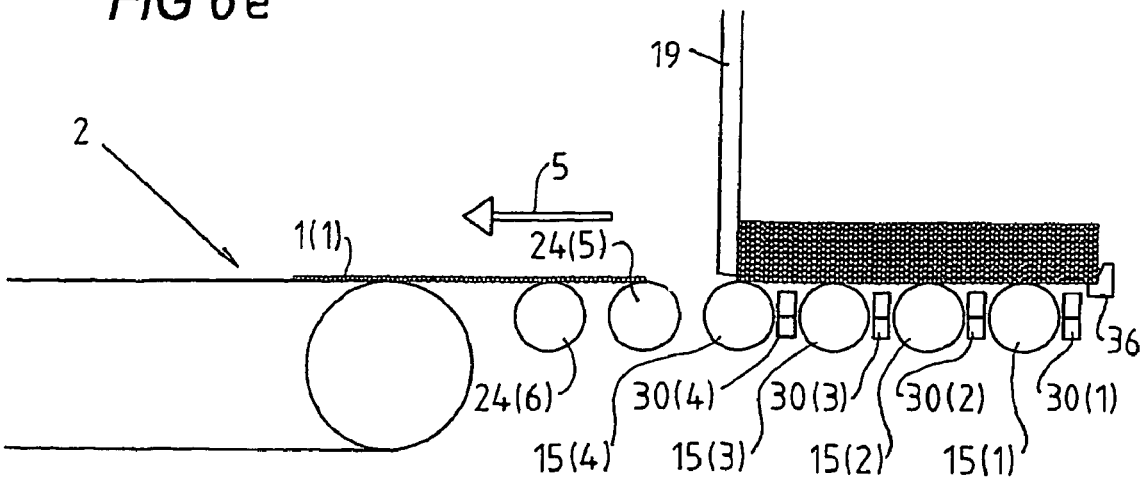

At the end of the feeding cycle all the wheel shafts 15(1), 15(2), 15(3) and 15(4) are immobile and all the relieving elements 30(1), 30(2) and 30(3) are in their lowermost position, as shown in FIG. 6*f*. The sheet-feeding device described herein is now ready for the next feeding cycle.

Synchronously with the sheet processing cycle (working cycle) of the converting machine the control unit 20 causes the motors 16 to rotate the shafts 15(1)-15(4) and accelerate the wheels 17 to obtain a speed adapted to the converting machine and the sheet-feeding cycle described above is repeated.

The separating device or gate 19 allows the feeding of only one sheet 1(1) at a time and holds the stack of sheets in place by interacting with a rear sheet support 36 arranged opposite the separating device. The sheet support 36 is displaceably arranged on the feeding table 4 in the direction of transportation of the sheets 5 and in the opposite direction, respectively. A motor (not shown), for example a servo motor, moves the sheet support so that the distance between it and the separating device is adapted to the length of the sheets. The adjustment of the position of the sheet supports is effected by the control unit 20.

By programming the sheet length in the control unit the unit issues all the commands necessary for actuating the wheel shafts by means of the motors 16, for operating the movements of the relieving elements by means of the raising devices 32 and for setting the sheet support 36. Changing or adjusting said operations is relatively easy and is done by a corresponding (re)programming of the control unit. The movement pattern for the rear edge of the sheet is programmed in the checking program of the control unit (cam profile) for the respective shafts. The distance which the periphery of a wheel of a shaft is to rotate before the rear edge leaves the wheel is controlled by the control unit and is programmed for the actual sheet length used in the machine at the moment. This also controls the working cycle of the raising devices. Moreover, the control unit is advantageously programmed to start each sheet-feeding cycle by initially rotating all the shafts in the first low-pressure chamber in a direction opposite of the direction of transportation 5, whereby the sheet which is to be fed is moved backwards a short distance away from the separating device in order to detach the front edge of the sheet from the separating device. Subsequently, the shafts are caused to rotate in the direction of transportation and the sheet can pass beneath the sheet support without being damaged or getting stuck.

The control unit 20 is connected to the speed (machine speed) and position of the transportation device 2 or of the subsequent process step (printing, slitting, punching or folding) in order to adapt the sheet-feeding speed (the acceleration of the motors) and the position of the sheet thereto.

The invention is not limited to that described above or shown in the drawings, but can be changed within the scope of the accompanying claims.

The invention claimed is:

1. A device for feeding sheets one by one from a stack of sheets to a transportation device for transporting the sheet to a process station, comprising:

a first low-pressure chamber, a number of separately driven shafts which are positioned perpendicular to the direction of transportation of the sheets, which are arranged in the low-pressure chamber essentially equi-distantly spaced from one another, and which each carry a plurality of wheels with friction lining, each shaft being driven by its own motor which is connected to and controlled by a control unit, a separating device which is arranged essentially vertically above the low-pressure chamber and at a distance from the low-pressure chamber that is somewhat larger than the thickness of a sheet, and at least one relieving element arranged in a vertically displaceable manner before and at a distance from the closest shaft relative to the direction of transportation of the sheets and which is connected to and controlled by said control unit wherein said control unit is arranged to control the relieving element such that the relieving element is raised to a supporting position for the second lowermost sheet of the stack of sheets, essentially at the same time as a rear edge of a lowermost sheet being fed, relative to the direction of transportation of the lowermost sheet, is moved past said relieving element.

2. A device as claimed in claim 1, wherein the relieving element has the form of a rail, which extends parallel to said shafts and between side walls of the device.

3. A device as claimed in claim 2, wherein at least one relieving element is arranged before each shaft that is positioned before the separating device in the direction of transportation of the sheets, and wherein each relieving element is connected to and individually controlled by said control unit.

4. A device as claimed in claim 2, wherein each relieving element is raised and lowered by an associated electric raising device and wherein the motor of each shaft is an electrically driven servo motor.

5. A device as claimed in claim 2, further comprising:

a rear sheet support which supports the end of the stack of sheets located opposite the separating device and wherein the rear sheet support is displaceably arranged in the direction of transportation of the sheets and connected to and controlled by said control unit.

6. A device as claimed in claim 1, wherein at least one relieving element is arranged before each shaft that is positioned before the separating device in the direction of transportation of the sheets and wherein each relieving element is connected to and individually controlled by said control unit.

7. A device as claimed in claim 6, wherein each relieving element is raised and lowered by an associated electric raising device, and wherein the motor of each shaft is an electrically driven servo motor.

8. A device as claimed in claim 1, wherein each relieving element is raised and lowered by an associated electric raising device, and wherein the motor of each shaft is an electrically driven servo motor.

9. A device as claimed in claim 8, wherein the associated electric raising device is an electromagnet.

10. A device as claimed in claim 1, further comprising:

a rear sheet support which supports the end of the stack of sheets located opposite the separating device, wherein the rear sheet support is displaceably arranged in the direction of transportation of the sheets and connected to and controlled by said control unit.

11. A method for feeding sheets one by one from a stack of sheets in a feeding device to a transportation device for transporting the sheet to a process station, the feeding device comprising a low-pressure chamber, a number of separately driven shafts which are positioned perpendicular to the direction of transportation and are arranged in the low-pressure chamber essentially equidistantly spaced from one another and which each carry a plurality of wheels with friction lining, each shaft being driven by its own drive motor, which is connected to and controlled by a control unit, and a separating device, which is arranged essentially vertically above the low-pressure chamber and at a distance from the low-pressure chamber that is somewhat larger than the thickness of a sheet, the method comprising:

feeding a lowermost sheet in the stack to the transportation device, while preventing a second lowermost sheet from moving by means of the separating device, accelerating the sheet by causing the wheels, which are immobile at the beginning of each feeding cycle, to rotate by means of the control unit connected to the drive motors of the wheels and to said process station, so that the sheet reaches its speed reference value depending on the working pace of the process station, raising a relieving element essentially at the same time as a rear edge of the lowermost sheet being fed, relative to the direction of transportation of the lowermost sheet, is moved past said relieving element, to a supporting position for the second lowermost sheet of the stack of sheets before the lowermost sheet being fed leaves a subsequent shaft, relative to the direction of transportation of the lowermost sheet, which carries wheels, and decelerating said subsequent shaft when the rear edge of the lowermost sheet being fed, as seen in the direction of transportation, leaves the wheels of the subsequent shaft.

12. A method as claimed in claim 11, wherein:

one or more relieving elements are provided before each wheel shaft, each shaft is decelerated in succession as the rear edge of the lowermost sheet leaves the wheels of that shaft, and the relieving element arranged before each shaft relative to the direction of transportation, is raised to said supporting position when the rear edge of the lowermost sheet being fed, relative to the direction of transportation, leaves the wheels of the respective shaft.

13. A method as claimed in claim 12, further comprising:

lowering the receiving element arranged immediately before a shaft, relative to the direction of transportation of the lowermost sheet being fed, from said sheet supporting position when the associated shaft has been brought to a standstill, the second lowermost sheet being then supported by the wheels of said immobile shaft.

14. A method as claimed in claim 12, wherein, at the beginning of each feeding cycle:

the stack of sheets rests on the wheels of the shafts and the lowermost sheet is initially moved a minimal distance in the direction opposite to its direction of transportation and, subsequently, moved in its direction of transportation.

15. A method as claimed in claim 12, further comprising:

controlling sheet support which is displaceably arranged in the direction of transportation and which is located opposite the separating devices controlling when each shaft is to be decelerated, controlling when the relieving elements are to be raised and lowered, respectively, and controlling the distance of a sheet support from the separating device, and wherein said controlling is carried out by said control unit, and wherein said control unit has been programmed with the length of the sheets in the direction of transportation of the sheets.

16. A method as claimed in claim 11, further comprising:

lowering the receiving element arranged immediately before a shaft, relative to the direction of transportation of the lowermost sheet being fed, from said sheet supporting position when the associated shaft has been brought to a standstill, the second lowermost sheet being then supported by the wheels of said immobile shaft.

17. A method as claimed in claim 16, wherein, at the beginning of each feeding cycle:

the stack of sheets rests on the wheels of the shafts and the lowermost sheet is initially moved a minimal distance in the direction opposite to its direction of transportation and, subsequently, moved in its direction of transportation.

18. A method as claimed in claim 16, further comprising:

controlling a sheet support which is displaceably arranged in the direction of transportation and which is located opposite the separating device, controlling when each shaft is to be decelerated, controlling when the relieving elements are to be raised and lowered, respectively, and controlling the distance of a sheet support from the separating device, and wherein said controlling is carried out by said control unit, and wherein said control unit has been programmed with the length of the sheets in the direction of transportation of the sheets.

19. A method as claimed in claim 11, wherein, at the beginning of each feeding cycle:

the stack of sheets rests on the wheels of the shafts and the lowermost sheet is initially moved a minimal distance in the direction opposite to its direction of transportation and, subsequently moved in its direction of transportation.

20. A method as claimed in claim 19, further comprising:

controlling a sheet support which is displaceably arranged in the direction of transportation and which is located opposite the separating device, controlling when each shaft is to be decelerated controlling when the relieving elements are to be raised and lowered, respectively, and controlling the distance of the sheet support from the separating device, and wherein said controlling is carried out by said control unit, and wherein said control unit has been programmed with the length of the sheets in the direction of transportation of the sheets.

21. A method as claimed in claim 11, further comprising:

controlling a sheet support which is displaceably arranged in the direction of transportation and which is located opposite the separating device, controlling when each shaft is to be decelerated, controlling when the relieving elements are to be raised and lowered, respectively, controlling the distance of a sheet support from the separating devices wherein said controlling is carried out by said control unit, and wherein said control unit has been programmed with the length of the sheets in the direction of transportation of the sheets.

* * * * *